US006811090B2

(12) United States Patent
Yogi et al.

(10) Patent No.: US 6,811,090 B2
(45) Date of Patent: Nov. 2, 2004

(54) MINUTE DROPLET FORMING METHOD A MINUTE DROPLET FORMING APPARATUS

(75) Inventors: Osamu Yogi, Hamamatsu (JP); Mitsuru Ishikawa, Hamamatsu (JP); Tomonori Kawakami, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 340 days.

(21) Appl. No.: 10/058,121

(22) Filed: Jan. 29, 2002

(65) Prior Publication Data

US 2002/0063083 A1 May 30, 2002

Related U.S. Application Data

(63) Continuation-in-part of application No. PCT/JP00/05221, filed on Aug. 3, 2000.

(30) Foreign Application Priority Data

Aug. 3, 1999 (JP) ..... P11-219972

(51) Int. Cl.[7] ..... B05B 17/04; B05B 3/04

(52) U.S. Cl. ..... 239/4; 239/102.2; 239/690; 239/704

(58) Field of Search ..... 239/3, 4, 102.1, 239/102.2, 690, 690.1, 704, 706–708, 533.1, 589

(56) References Cited

U.S. PATENT DOCUMENTS 3,060,429 A * 10/1962 Winston ..... 346/11
4,621,268 A * 11/1986 Keeling et al. ..... 347/82
5,560,543 A * 10/1996 Smith et al. ..... 239/102.2
5,813,614 A * 9/1998 Coffee ..... 239/690
6,252,129 B1 * 6/2001 Coffee ..... 602/42

FOREIGN PATENT DOCUMENTS

DE 2949808 A * 7/1980 ..... B41J/3/04
JP 11300975 A * 11/1999 ..... B41J/2/06

* cited by examiner

*Primary Examiner*—Patrick Brinson
(74) *Attorney, Agent, or Firm*—Morgan, Lewis & Bockius LLP

(57) ABSTRACT

A minute droplet forming apparatus comprises a nozzle 1 for storing therewithin a liquid 2 for forming a droplet 3; a substrate 5, disposed so as to face the tip of the nozzle 1, for mounting the droplet 3 dropped from the tip of the nozzle 1; and a pulse power supply 10 for applying a pulse voltage between an electrode 12 arranged in the liquid 2 within the nozzle 1 and the substrate 5. After a liquid column 2*a* is formed by projecting the liquid from the nozzle tip by applying the pulse voltage between substrate 5 and the electrode 12, a nickel piece 7 disposed within the nozzle 1 is moved to the tip part of the nozzle 1 by an XYZ stage 9 by way of a magnet 8, so as to enhance the fluid resistance in the nozzle tip part, thereby causing a setback force for returning the liquid 2 into the nozzle 1, by which the droplet 3 is isolated from the liquid column 2*a*.

6 Claims, 9 Drawing Sheets

Fig.3A
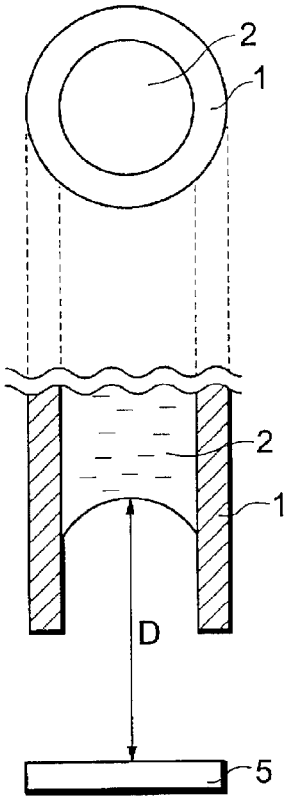
Fig.3B
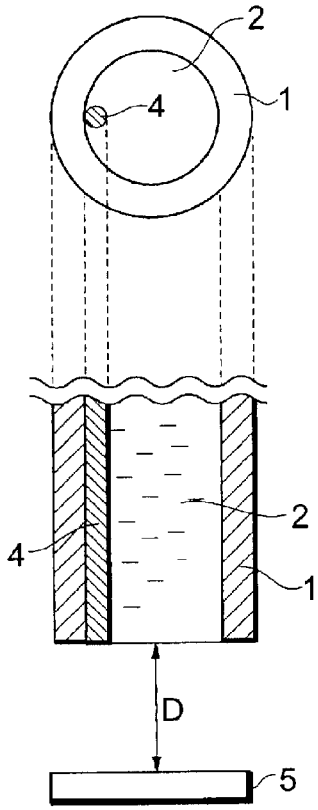
Fig.3C
Fig.3D

MINUTE DROPLET FORMING METHOD A MINUTE DROPLET FORMING APPARATUS

RELATED APPLICATIONS

This is a Continuation-In-Part application of International Patent Application serial No. PCT/JP00/05221 filed on Aug. 3, 2000 now pending.

BACKGROUND OF THE INVENTION

1. Field of the Invention

The present invention relates to a minute droplet forming method and minute droplet forming apparatus applicable to various solutions.

2. Related Background Art

A method utilizing electrostatic attraction has conventionally been known as a method for forming a droplet. This method is one in which a pulse voltage is applied between a nozzle containing a liquid for forming a droplet and a substrate arranged to face a nozzle tip acting as a droplet dropping port, so as to attract the liquid from the nozzle tip toward the substrate by an electrostatic force, whereby thus formed droplet is caused to drop onto the substrate. According to this method, the formed droplet has larger and smaller sizes as the peak value of the applied pulse voltage is raised and lowered, respectively, whereby the size of the formed droplet can be controlled when the peak value is regulated.

SUMMARY OF THE INVENTION

In the above-mentioned droplet forming method based on the electrostatic attraction, however, the size of the formed droplet depends on the diameter of the nozzle tip, whereby droplets having a predetermined size or smaller cannot be formed. Namely, as the peak value of the pulse voltage applied for forming a minute droplet is lowered, the electrostatic force fails to overcome the surface tension occurring at the nozzle tip at a certain peak value or lower, thereby forming no droplets. Therefore, it is necessary to use a nozzle having a small tip diameter when forming a minute droplet. Nozzles having a small diameter, however, are problematic in that they are frequently clogged with dust and the like contained in the liquid.

Therefore, it is an object of the present invention to provide a minute droplet forming method and minute droplet forming apparatus solving the problem mentioned above.

For solving the above-mentioned problem, the minute droplet forming method in accordance with the present invention is a minute droplet forming method of electrostatic attraction type for forming a minute droplet by attracting a liquid by applying a pulse voltage to a nozzle tip containing the liquid, the method comprising a step of applying the pulse voltage between a substrate arranged to face the nozzle tip with a predetermined space therebetween and the liquid within the nozzle so as to project the liquid from the nozzle tip and form a liquid column, and a step of isolating the droplet by enhancing a fluid resistance within said nozzle so as to cause a setback force for returning said liquid into said nozzle to act on said formed liquid column.

The minute droplet forming apparatus in accordance with the present invention, on the other hand, comprises (1) a nozzle for storing therewithin a liquid for forming a droplet; (2) a substrate, arranged so as to face a tip of the nozzle, for mounting the droplet dropped from the nozzle tip; (3) a pulse power supply for applying a pulse voltage between the liquid within the nozzle and the substrate; (4) a fluid regulating unit adapted to change a fluid resistance within said nozzle; and (5) a control unit for controlling the pulse power supply and the fluid regulating unit.

In the minute droplet forming method and apparatus in accordance with the present invention, a liquid column, which is a liquid drawn out of the nozzle tip, is returned into the nozzle by the setback force, whereby a droplet is isolated from the liquid column. Thus isolating the droplet makes it possible to form a droplet having a diameter smaller than the nozzle diameter. For causing the setback force to act, in the present invention the fluid resistance within the nozzle is raised so as to slow down the velocity of flow generated within the nozzle by the electrostatic force, thus forming a negative pressure at the nozzle tip part, which is utilized as the setback force.

Thus controlling the setback force makes it possible to adjust the size of the formed droplet without changing the diameter of the nozzle.

It will be preferable if each of the forming and isolating of droplets is carried out under a saturation vapor pressure, since thus formed droplets become hard to evaporate.

Preferably, the nozzle is a core nozzle having a core arranged within the nozzle. When the nozzle is a core nozzle as such, the influence of surface tension can be lowered.

The present invention will become more fully understood from the detailed description given hereinbelow and the accompanying drawings. They are given by way of illustration only, and thus should not be considered limitative of the present invention.

Further scope of applicability of the present invention will become apparent from the detailed description given hereinafter. However, it is clear that the detailed description and specific examples, while indicating preferred embodiments of the invention, are given by way of illustration only, and various changes and modifications within the spirit and scope of the invention will become apparent to those skilled in the art from this detailed description.

BRIEF DESCRIPTION OF THE DRAWINGS

FIGS. 3A to 3D are views showing nozzle tips and liquid levels near the nozzle tips, wherein FIGS. 3A and 3C are sectional views whereas FIGS. 3B and 3D are their corresponding views seen from the respective lower faces;

DESCRIPTION OF THE PREFERRED EMBODIMENTS

In the following, preferred embodiments of the present invention will be explained in detail with reference to the accompanying drawings. For making it easier to understand the explanation, constituents identical to each other among the drawings will be referred to with numerals identical to each other whenever possible, without repeating their overlapping descriptions.

Figure 1A:
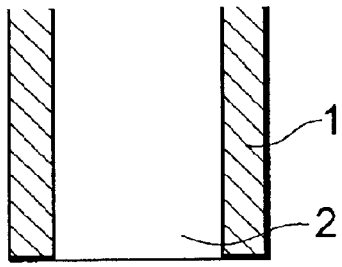
FIGS. 1A to 1D are views showing a nozzle tip and states of liquid level near the nozzle tip.
Figure 1B:
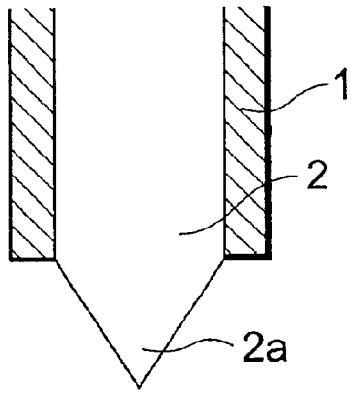
Figure 1C:
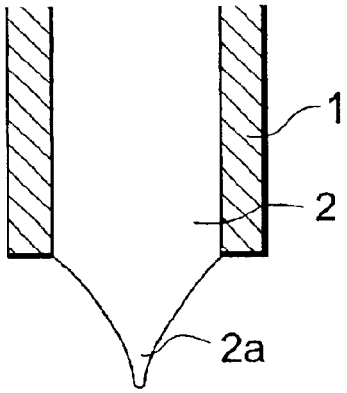
Figure 1D:
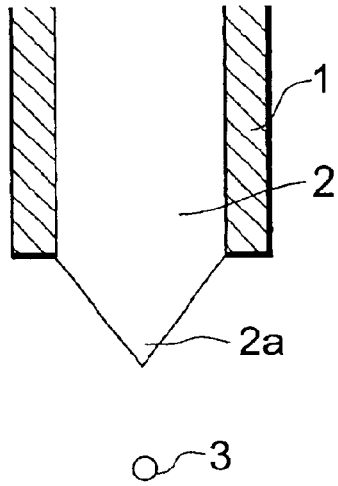

First, the principle of the present invention will be explained with reference to FIGS. 1A to 1D. FIGS. 1A to 1D are views for explaining a nozzle tip and states of a liquid near the nozzle tip. Though a liquid 2 within a nozzle 1 is normally contained within the nozzle 1 by a surface tension against gravity (see FIG. 1A), the liquid 2 is drawn out of the tip of the nozzle 1 by an electrostatic force when a pulse voltage is applied between the liquid 2 within the nozzle 1 and a substrate (not shown) arranged below the nozzle 1 perpendicularly thereto, whereby a liquid column 2*a* is formed (see FIG. 1B). When a setback force (which is a force, acting perpendicularly upward, for returning the liquid column 2*a* into the nozzle 1) is subsequently caused to act on the liquid column 2*a*, the liquid column 2*a* becomes thinner as shown in FIG. 1C than that in the case where no setback force acts thereon, so that the tip of the liquid column 2*a* is isolated by the electrostatic force and setback force, whereby a droplet 3 is formed (see FIG. 1D).

When the tip of the liquid 2 drawn out of the tip of the nozzle 1 is thus isolated by the setback force, the droplet 3 having a diameter smaller than that of the tip of the nozzle 1 can be formed. Also, the size of the droplet 3 to be formed can be controlled by changing the timing at which the setback force is applied and the size thereof.

Figure 2:
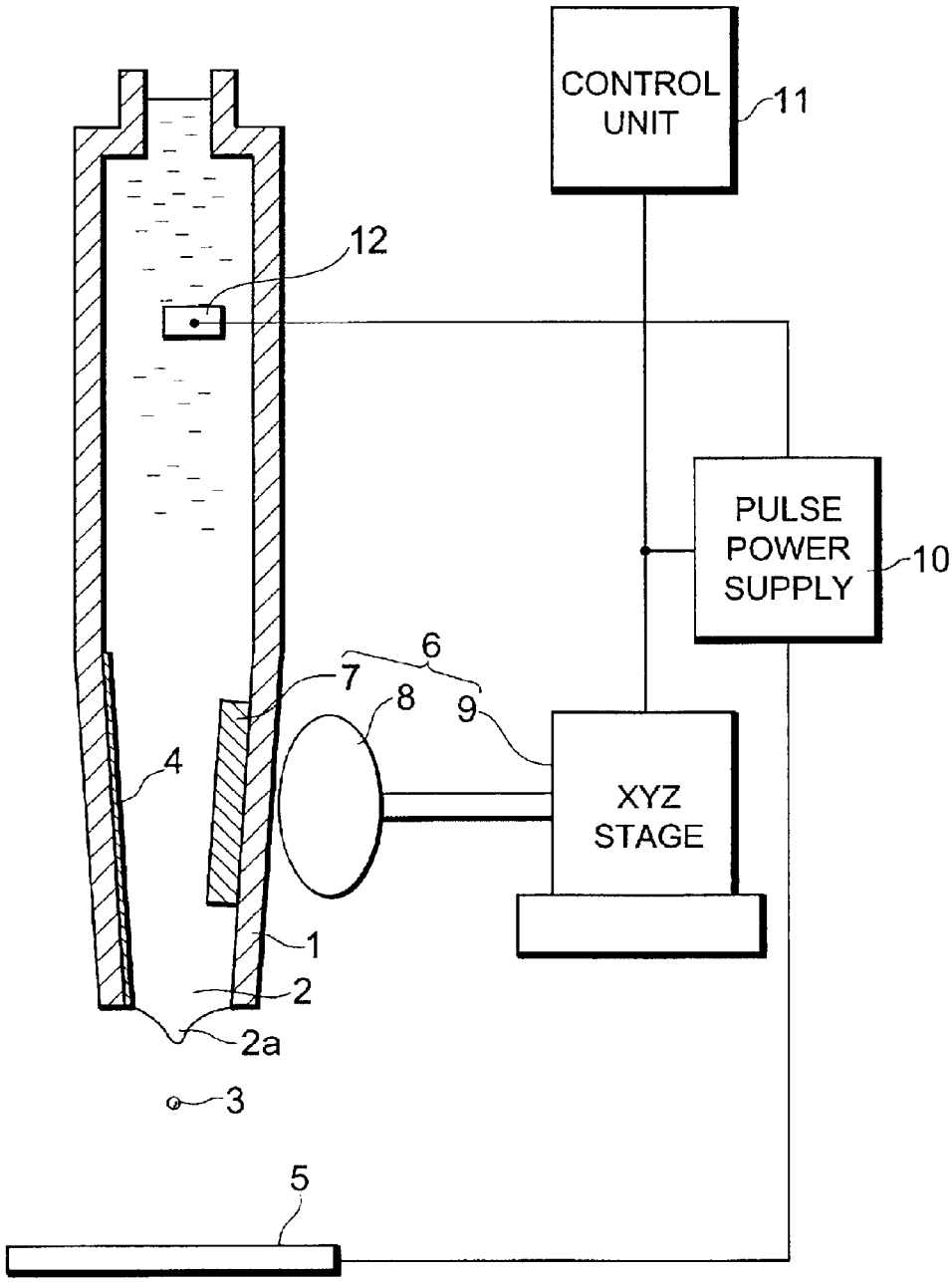
FIG. 2 is a view showing a first embodiment of the minute droplet forming apparatus in accordance with the present invention.

FIG. 2 is a view showing a first embodiment of the minute droplet forming apparatus in accordance with the present invention. The minute droplet forming apparatus in accordance with the first embodiment comprises a nozzle 1 for storing a liquid 2 for forming a droplet 3, a substrate 5 arranged so as to face a tip part of the nozzle 1, a pulse power supply 10 for applying a pulse voltage between an electrode 12 arranged in the liquid 2 within the nozzle 1 and the substrate 5, a fluid resistance regulating unit 6 for regulating the fluid resistance, and a control unit 11 for controlling the pulse power supply 10 and the fluid resistance regulating unit 6. The fluid resistance regulating unit 6 is constituted by a nickel piece 7, disposed within the nozzle 1, for raising/lowering the fluid resistance; a magnet 8 for operating the nickel piece 7 from the outside of the nozzle 1; and an XYZ stage 9 for movably supporting the magnet 8. Namely, the XYZ stage 9 is controlled by the control unit 11, whereby the nickel piece 7 itself can be moved by way of the magnet 8. The nickel piece 7 used within the nozzle 1 here is a fragment having a diameter of 10 $\mu$m and a length of 500 $\mu$m, and is disposed near the nozzle 1.

The nozzle 1 has an inner diameter of 10 $\mu$m near its tip, and is made by drawing glass having a core 4. The nozzle 1 having the core 4 is used in order to align the liquid level with the tip part of the nozzle 1. FIGS. 3A to 3D are views showing tips of nozzles 1 seen from their lower faces (FIGS. 3A and 3C), and sectional views of the nozzles 1 showing liquid levels near the tips of the nozzles 1 (FIGS. 3B and 3D). Though the liquid level is positioned at a location slightly inside the nozzle 1 from the nozzle tip part (see FIG. 3B) due to surface tension in the case of the nozzle 1 without the core 4 (see FIG. 3A), the liquid within the nozzle 1 is drawn toward the tip part of the nozzle 1 due to a capillary phenomenon when the nozzle 1 having the core 4 is used (see FIG. 3C), whereby the liquid level is positioned near the tip part of the nozzle 1 (see FIG. 3D). Though it is not always necessary to use the nozzle 1 having the core 4, it will be preferred if the nozzle 1 having the core 4 is used, since effects which will be explained later can be obtained.

The operation of the minute droplet forming apparatus in accordance with the first embodiment, i.e., an example of the minute droplet forming method in accordance with the present invention, will now be explained with reference to FIG. 2.

First, the pulse power supply 10 applies a pulse voltage between the electrode 12 disposed in the liquid 2 within the nozzle 1 and the substrate 5, whereby the liquid 2 is drawn out of the tip of the nozzle 1 by an electrostatic force. Here, since the nozzle 1 having the core 4 is used, the liquid level aligns with a predetermined position near the tip of the nozzle 1 (see FIG. 3D) in the state before the pulse voltage is applied, whereby the distance D between the liquid level and the substrate 5 is held constant. As a consequence, the electrostatic force acting between the liquid level and the substrate 5 when a predetermined pulse voltage is applied thereto becomes always the same, so that not only the amount of the liquid 2 drawn out of the nozzle 1 but also the size of the droplet 3 can accurately be controlled.

After the liquid column 2*a* is formed by drawing the liquid 2 out of the nozzle 1, the fluid resistance regulating unit 6 raises the fluid resistance near the tip of the nozzle 1, thereby causing a setback force to act on the liquid column 2*a*. Specifically, the nickel piece 7 disposed within the nozzle 1 is moved toward the tapered tip of the nozzle 1. Here, the nickel piece 7 is moved, by way of the magnet 8 disposed outside the nozzle 1, by the XYZ stage 9 controlled by the control unit 11. As the nickel piece 7 is thus moved toward the tip of the nozzle 1, the flow path is narrowed in the vicinity of the tip part of the nozzle 1, whereby the fluid resistance increases in the vicinity of the tip part of the nozzle 1. Therefore, a negative pressure occurs in the tip part of the nozzle 1, so as to acts as a setback force on the liquid column 2*a*.

When the setback force acts, a part of the liquid column 2*a* is isolated by two forces, i.e., the electrostatic force and setback force acting in directions opposite from each other, whereby the droplet 3 is formed.

In the minute droplet forming apparatus of the first embodiment, the fluid resistance regulating unit 6 is provided as a setback force generating means. As a consequence, after the liquid 2 is drawn out of the tip of the nozzle 1 by the electrostatic force, the droplet 3 can be formed by isolating it from the liquid column 2 by the setback force caused upon increasing the fluid resistance. When the setback force acts to form the droplet 3, the minute droplet 3 can be formed.

Also, the nozzle 1 having the core 4 is used in the minute droplet forming apparatus of the first embodiment. As a consequence, the liquid level is positioned at the tip of the nozzle 1 before the pulse voltage is applied, whereby a predetermined amount of liquid column 2*a* is formed by a predetermined pulse voltage. Therefore, the size of the formed droplet 3 can accurately be controlled when the timing at which the setback force is applied and the size thereof are regulated by the control unit 11.

Figure 4:
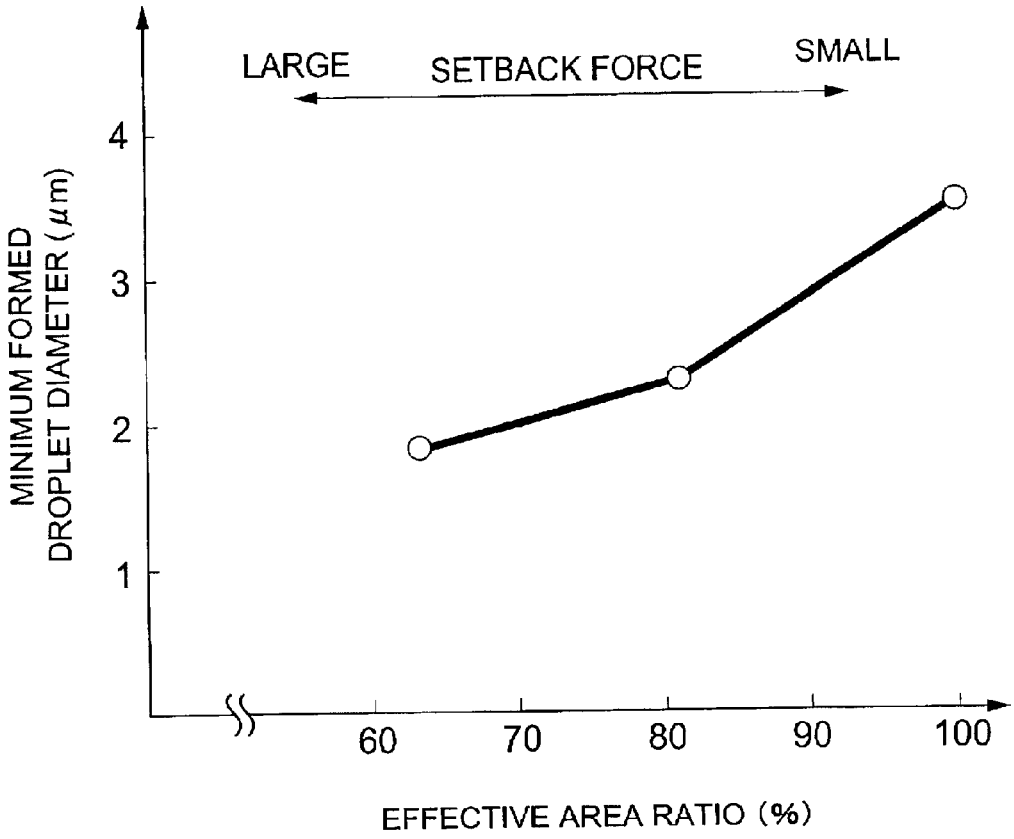
FIG. 4 is a graph showing characteristics of droplets formed by using the minute droplet forming apparatus of the first embodiment.

FIG. 4 is a graph showing results obtained when the minute droplet 3 is formed by using the minute droplet forming apparatus of the first embodiment. The abscissa of the graph of FIG. 4 indicates the ratio between the flow path area at the tip part of the nozzle 1 and the flow path area narrowed by the nickel piece 7 as the effective area ratio. Here, the case yielding an effective area ratio of 100% is a case where no nickel piece 7 exists. As the effective area ratio decreases, the fluid resistance increases, whereby the setback force becomes greater as shown in FIG. 4. The ordinate of the graph of FIG. 4 shows the diameter of the droplet 3 formed.

As shown in FIG. 4, it has been verified that, as the setback force increases, the formed minute droplet 3 becomes smaller, which yields the droplet 3 having such a minute amount that it cannot be obtained by the attraction based on the electrostatic force alone, and that its size is controllable by changing the effective area ratio.

While other embodiments will be explained in the following, each of the following embodiments is the same as that of the first embodiment except that the setback force generating means (constituted by the nickel piece 7, and the magnet 8 and XYZ stage 9 for controlling the same) in the minute droplet forming apparatus of the first embodiment is replaced by a different configuration. Also, its operation (droplet forming method) is the same as that of the first embodiment in that the liquid 2 is drawn out of the tip of the nozzle 1 by applying a pulse voltage between the liquid 2 (the electrode 12 disposed in the liquid 2 in practice) within the nozzle 1 and the substrate 5 arranged so as to face the tip of the nozzle 1, and that the minute droplet 3 is isolated from the liquid column 2*a* by the setback force generated by the setback force generating means.

Figure 5:
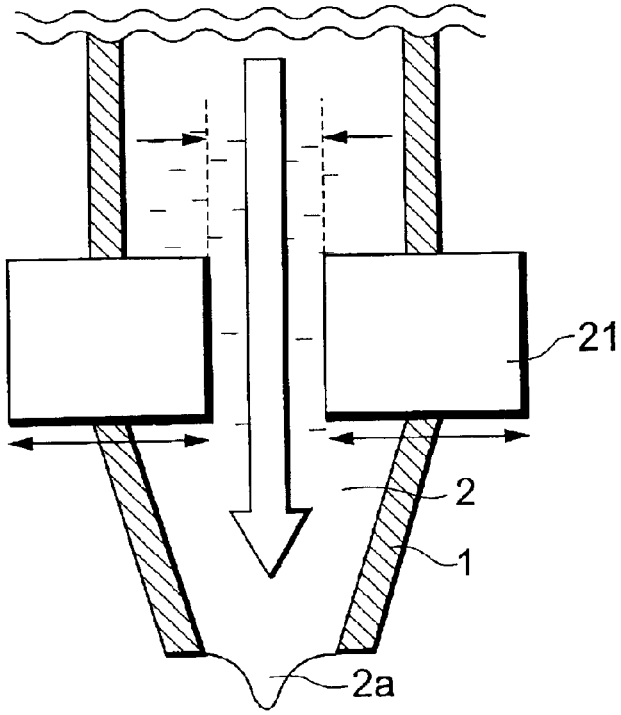
FIGS. 5 to 7 are views showing respective nozzle parts in second to fourth embodiments of the minute droplet forming apparatus in accordance with the present invention.

FIG. 5 is a view showing the tip part of the nozzle 1 in a second embodiment of the minute droplet forming apparatus in accordance with the present invention. The setback force generating means in this embodiment is constituted by a piezoelectric device 21, disposed near the tip of the nozzle 1, having a form surrounding the flow path.

In this embodiment, current is caused to flow through the piezoelectric device 21 after the liquid 2 is drawn out, whereby the piezoelectric device is inflated so as to narrow the flowpath. As a consequence, fluid resistance increases in the vicinity of the tip part of the nozzle 1, so that a negative pressure occurs near the tip part of the nozzle 1, whereby a setback force acts on the liquid column 2*a*.

Figure 6:
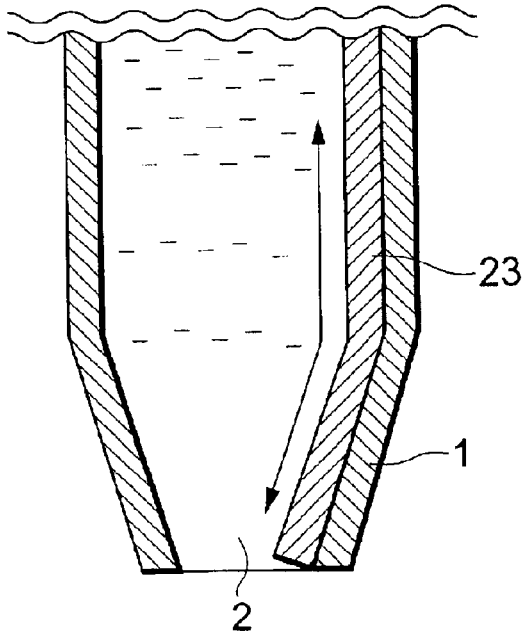

FIG. 6 is a view showing the tip part of the nozzle 1 in a third embodiment of the minute droplet forming apparatus in accordance with the present invention. The setback force generating means in this embodiment is constituted by a wire 23 disposed so as to extend along the longitudinal direction of the nozzle 1 therewithin.

In this embodiment, the wire 23 is moved toward the tapered tip of the nozzle 1 after the liquid 2 is drawn out, so as to narrow the flow path. Here, the wire 23 is exposed to the outside of the nozzle 1 on the side opposite from the tip part of the nozzle 1, and is controlled by an unshown control unit connected thereto.

As a consequence, the flow path narrows in the vicinity of the tip part of the nozzle 1, so that the fluid resistance increases, thereby generating a negative pressure in the vicinity of the tip part of the nozzle 1. This negative pressure acts as a setback force on the liquid column 2*a*.

Figure 7:
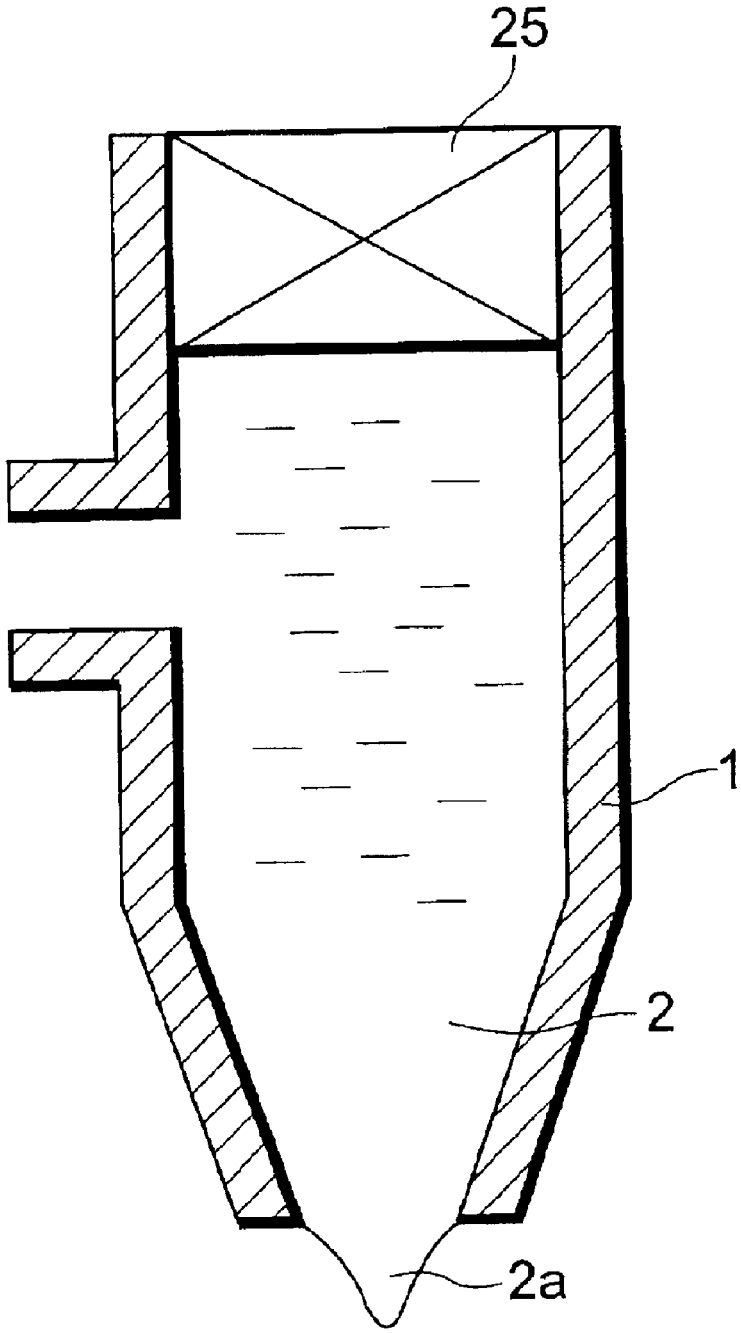

FIG. 7 is a view showing the tip part of the nozzle 1 in a fourth embodiment of the minute droplet forming apparatus in accordance with the present invention. The setback force generating means in this embodiment is constituted by a piezoelectric device 25 disposed at an end part opposite from the tip of the nozzle 1.

In this embodiment, the piezoelectric device 25 is inflated beforehand, and is constricted after the liquid 2 is drawn out. This enhances the volume of the nozzle 1, so as to generate a negative pressure within the nozzle 1, thereby causing a setback force to act on the liquid column 2*a*.

Figure 8:
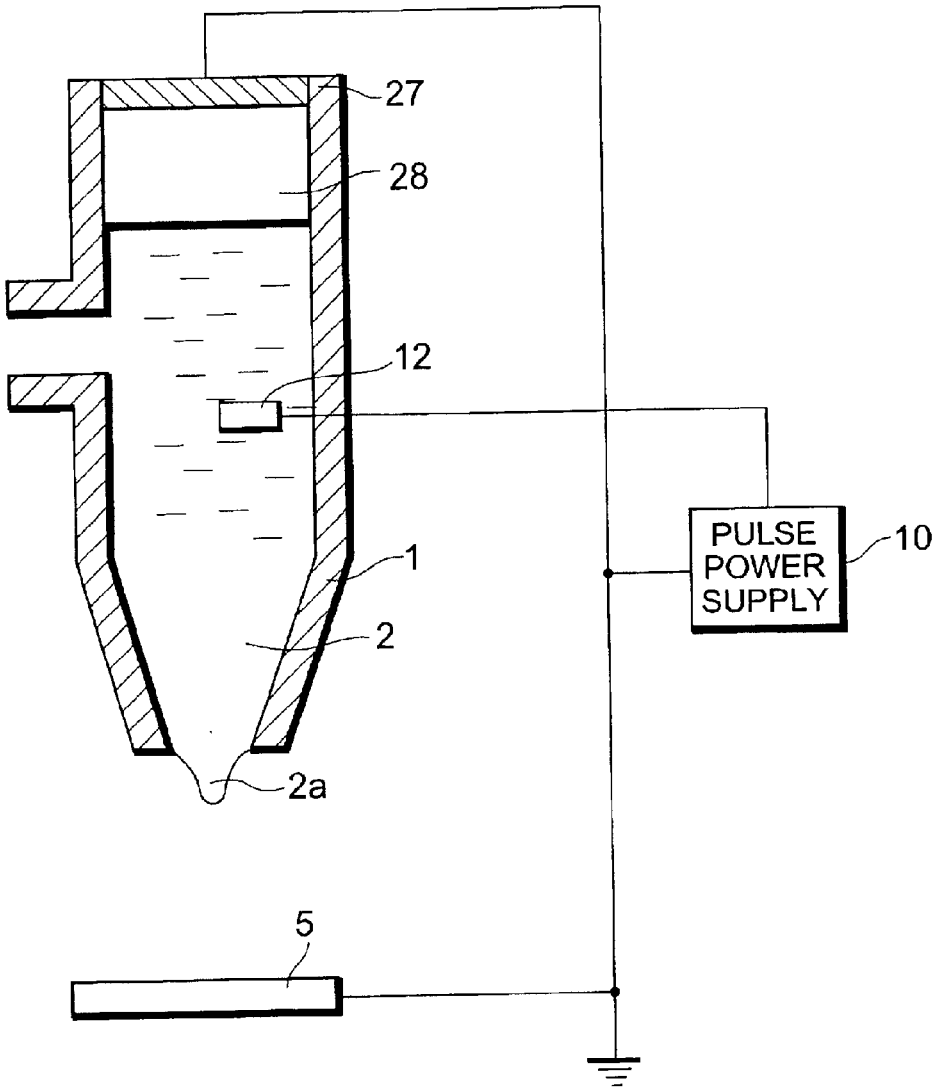
FIG. 8 is a view showing a main part of a fifth embodiment of the minute droplet forming apparatus in accordance with the present invention.

FIG. 8 is a view showing a fifth embodiment of the minute droplet forming apparatus in accordance with the present invention. The setback force generating means in this embodiment is the same as the configuration for drawing the liquid 2 out of the tip of the nozzle 1, and is constituted by a power supply 10 (also acting as the pulse power supply 10) for applying a voltage between an end electrode 27 disposed at an end part opposite from the tip of the nozzle 1 and the electrode 12 disposed in the liquid 2 within the nozzle 1. The liquid 2 does not fill up to the end part opposite from the nozzle 1, thereby forming a space 28 between the end electrode 27 and the liquid 2.

In the minute droplet forming apparatus of this embodiment, after the liquid 2 is drawn out, a voltage is applied between the end electrode 27 and the electrode 12 disposed in the liquid 2, so as to pull the liquid 2 within the nozzle 1 toward the end electrode 27 by an electrostatic force. Since the end electrode 27 is disposed on the side opposite from the tip of the nozzle 1, this pulling force acts as a setback force on the liquid column 2*a*.

Figure 9:
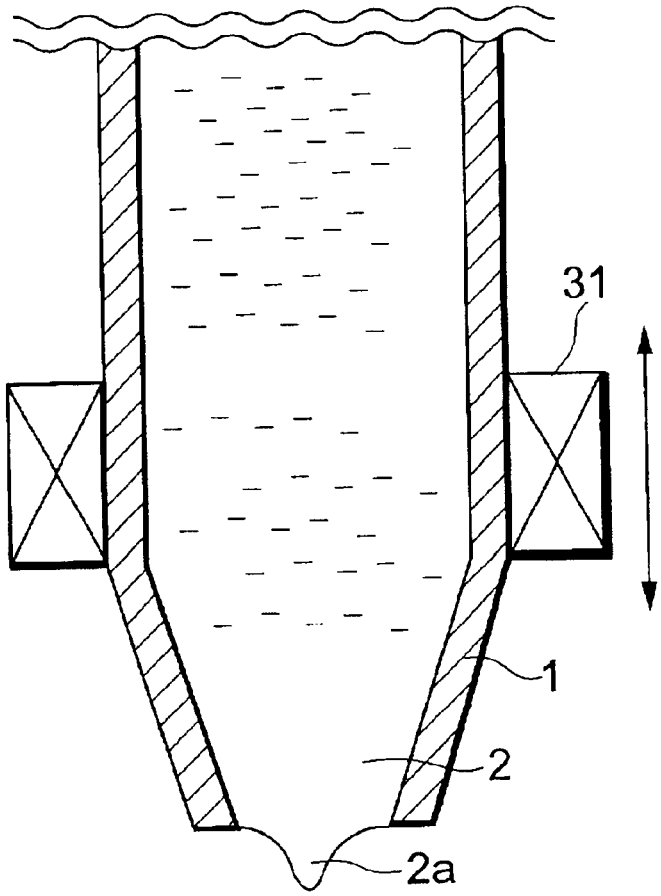
FIG. 9 is a view showing a nozzle part of a sixth embodiment of the minute droplet forming apparatus in accordance with the present invention.

FIG. 9 is a view showing a sixth embodiment of the minute droplet forming apparatus in accordance with the present invention. The setback force generating means in this embodiment is constituted by a micro stage (nozzle position changing mechanism) 31 disposed on the outside of the nozzle 1.

In this minute droplet forming apparatus, the position of the nozzle 1 is moved by the micro stage 31 in a direction by which the liquid column 2*a* and the substrate 5 (not depicted in FIG. 9) are distanced from each other. When the liquid column 2*a* at the tip of the nozzle 1 and the substrate 5 are distanced from each other, the electrostatic force acting between the liquid column 2*a* and the substrate 5 decreases. This causes a force for returning the liquid column 2*a* into the nozzle 1 to act on the liquid column 2*a*. Without being restricted to the micro stage 31, any nozzle position changing mechanism, e.g., piezoelectric device, maybe used as long as it can control the moving direction and moving distance. Similar effects are also obtained by a configuration in which the substrate 5 side is moved with respect to the nozzle as a matter of course.

Figure 10:
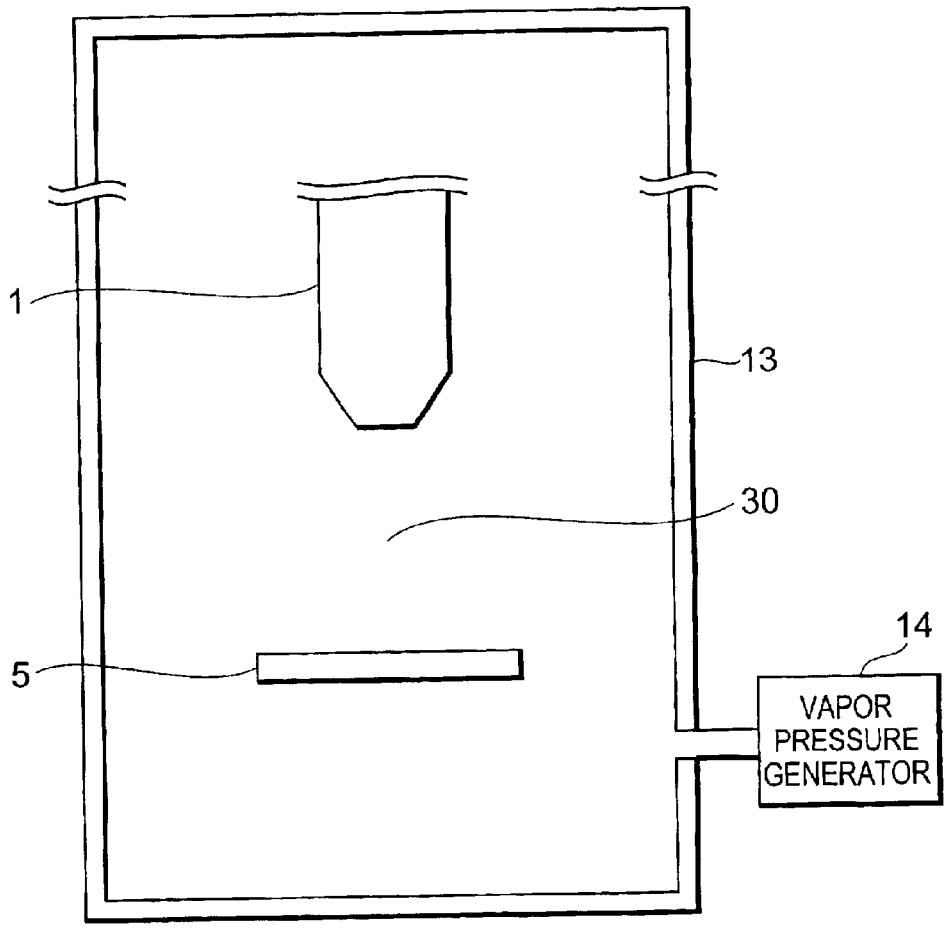
FIG. 10 is a view showing a seventh embodiment of the minute droplet forming apparatus in accordance with the present invention.

As shown in FIG. 10, for example, an environment maintaining unit comprising a shield 13 for covering at least a droplet forming space 30 between the nozzle 1 and the substrate 5, and a vapor pressure generator 14 for causing the inside of the shield 13 to maintain a saturation vapor pressure state of the liquid held within the nozzle 1 may further be provided. Forming a droplet under a saturation vapor pressure as such can prevent the formed droplet from evaporating.

Though embodiments of the present invention are explained in detail in the foregoing, the present invention is not restricted by the above-mentioned embodiments, and all the improvements as would be obvious to one skilled in the art are included in the present invention.

What is claimed is:

1. A minute droplet forming method of electrostatic attraction type for forming a minute droplet by attracting a liquid by applying a pulse voltage to a nozzle tip containing said liquid, said method comprising:

a step of applying said pulse voltage between a substrate arranged to face said nozzle tip with a predetermined space therebetween and said liquid within said nozzle so as to project said liquid from said nozzle tip and form a liquid column; and a step of isolating said droplet by enhancing a fluid resistance within said nozzle so as to cause a setback force for returning said liquid into said nozzle to act on said formed liquid column, wherein each of said forming and isolating of said droplet is carried out under a saturation vapor pressure of said liquid.

2. A minute droplet forming method according to claim 1, wherein a size of said droplet to be formed is adjusted by controlling said setback force.

3. A minute droplet forming method of electrostatic attraction type for forming a minute droplet by attracting a liquid by applying a pulse voltage to a nozzle tip containing said liquid, said method comprising:

a step of applying said pulse voltage between a substrate arranged to face said nozzle tip with a predetermined space therebetween and said liquid within said nozzle so as to project said liquid from said nozzle tip and form a liquid column; and a step of isolating said droplet by enhancing a fluid resistance within said nozzle so as to cause a setback force for returning said liquid into said nozzle to act on said formed liquid column, wherein said nozzle is a core nozzle having a core arranged therewithin.

4. A minute droplet forming apparatus comprising:

a nozzle for storing therewithin a liquid for forming a droplet;

a substrate, arranged so as to face a tip of said nozzle, for mounting said droplet dropped from said nozzle tip;

a pulse power supply for applying a pulse voltage between said liquid within said nozzle and said substrate;

a fluid regulating unit adapted to change a fluid resistance within said nozzle; and a control unit for controlling said pulse power supply and said fluid regulating unit, further comprising an environment maintaining unit for causing surroundings of said tip of said nozzle and said substrate to keep a saturation vapor pressure environment of said liquid within said nozzle.

5. A minute droplet forming apparatus comprising:

a nozzle for storing therewithin a liquid for forming a droplet;

a substrate, arranged so as to face a tip of said nozzle, for mounting said droplet dropped from said nozzle tip;

a pulse power supply for applying a pulse voltage between said liquid within said nozzle and said substrate;

a fluid regulating unit adapted to change a fluid resistance within said nozzle; and a control unit for controlling said pulse power supply and said fluid regulating unit, wherein said nozzle is a core nozzle having a core arranged within said nozzle.

6. A minute droplet forming method according to claim 3, wherein a size of said droplet to be formed is adjusted by controlling said setback force.

* * * * *